US007023406B1

(12) United States Patent
Nunomura et al.

(10) Patent No.: US 7,023,406 B1
(45) Date of Patent: Apr. 4, 2006

(54) METHOD AND APPARATUS FOR ENHANCING PEAK LUMINANCE ON PLASMA DISPLAY PANEL

(75) Inventors: Keiji Nunomura, Tokyo (JP); Yoshio Sano, Tokyo (JP); Toshiyuki Akiyama, Tokyo (JP); Hachiro Yamada, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/567,344

(22) Filed: May 9, 2000

(30) Foreign Application Priority Data

May 14, 1999 (JP) ..... 11-134215

(51) Int. Cl.
*G09G 3/28* (2006.01)

(52) U.S. Cl. ..... 345/63; 345/60; 345/690

(58) Field of Classification Search ..... 345/60, 345/63, 68, 204, 690, 691, 693, 208, 210, 345/211, 212
See application file for complete search history.

(56) References Cited

U.S. PATENT DOCUMENTS

| | | | | |
|---|---|---|---|---|
| 5,317,334 A | * | 5/1994 | Sano | 345/41 |
| 6,097,358 A | * | 8/2000 | Hirakawa et al. | 345/63 |
| 6,294,875 B1 | * | 9/2001 | Kurata et al. | 315/169.1 |
| 6,313,814 B1 | * | 11/2001 | Arimoto et al. | 315/169.1 |

FOREIGN PATENT DOCUMENTS

| | | |
|---|---|---|
| JP | 02-063093 | 3/1990 |
| JP | 03-238497 | 10/1991 |
| JP | 6-259034 | 9/1994 |
| JP | 08-032903 | 2/1996 |
| JP | 8-123365 | 5/1996 |
| JP | 8-305321 | 11/1996 |
| JP | 09-034402 | 2/1997 |
| JP | 9-244575 | 9/1997 |
| JP | 10-149128 | 6/1998 |
| JP | 10-149136 | 6/1998 |
| JP | 10-171403 | 6/1998 |
| JP | 10-228259 | 8/1998 |

* cited by examiner

*Primary Examiner*—Kent Chang
(74) *Attorney, Agent, or Firm*—Katten Muchin Zavis Rosenman

(57) ABSTRACT

To provide a plasma display device which implements a peak luminance higher than prior art, reduces the power dissipation, improves the smoothness of gradation display, and conducts clear display suitable especially for TV display. By setting a plurality of APL levels according to the average value of the scene brightness, and by shortening a sustaining pulse period and increasing the number of sustaining pulses of each sub-field in APL levels having small APL, the peak luminance is raised. Further, by making the sustaining pulse period long in APL levels having large APL requiring large discharge light emission power, the light emission efficiency is improved and the maximum power dissipation is reduced. The luminance distribution in the scene when the APL level is small is detected. On the basis of that information, setting of the number of sustaining pulses and the sustaining pulse period is changed in the same APL level. As a result, the peak luminance is increased, and the gradation smoothness in the dark scene is improved.

34 Claims, 14 Drawing Sheets

METHOD AND APPARATUS FOR ENHANCING PEAK LUMINANCE ON PLASMA DISPLAY PANEL

BACKGROUND OF THE INVENTION

1. Technical Field of the Invention

The present invention relates to a plasma display panel (PDP). In particular, the present invention relates to the PDP, wherein power dissipation is reduced, display luminance is increased, and gradation is displayed smoothly by controlling the number and period of pulses for sustaining discharge (SD) in plasma.

2. Description of the Prior Art

In the plasma display, fluorescent substance is exited by ultraviolet light generated by gaseous discharge, thereby making the fluorescent substance emit light. The plasma display is applied to large scene TV display and information display.

A PDP structure as shown in FIG. 10A is a top view of a back substrate with a part broken away. FIG. 10B is a sectional view of a front substrate, and FIG. 10C is a sectional view of the back substrate. Front substrate 100 acting as a display surface has a plurality of transparent electrodes 3 and a plurality of narrow-width bus electrodes 4 formed in parallel on glass substrate 1. Thereon, dielectric layer 7 and protection layer 8 are formed. As dielectric layer 7, low melting point glass is typically used. Magnesium oxide thin film, for example, is used for protection layer 8, because its secondary electron emission factor is sufficient, and it is not easily sputtered by the plasma gas. On glass substrate 2, data electrodes 5 are formed, and then dielectric, layer 10 and partitions 6 are formed. Powdered fluorescent substances 9 for R,G,B display are successively coated on bottom faces and side faces of grooves formed by the partitions. Thus, back substrate 200 is thus completed. The partitions ensures discharge spaces, and also have an effect of preventing discharge crosstalk and blurring of displayed color. Back substrate 200 and front substrate 100 are combined. Surroundings of both the substrates are sealed by frit glass. Finally, discharge gas having inert gas as its principal ingredient is introduced to complete PDP apparatus. The transparent electrodes with bus electrodes on front substrate 100 are paired. The gap between them becomes planar discharge gap 11. One of them is used as scan electrode 12, and the other of them is used as sustaining electrode 13. Data electrode 5, scan electrode 12 and sustaining electrode 13 are driven by various voltage waveforms.

FIG. 11 shows an example of a basic driving waveform of an AC planar discharge type PDP. In the scheme shown in FIG. 11, driving is conducted separately in write interval 23 including preparation interval 21 and scan interval 22, and sustaining interval 26 including sustaining discharge interval 24 and blanking interval 25. Scan pulses are applied successively to scan electrodes. According to this timing, a data pulse having a polarity opposite to that of the scan pulse is applied to the data electrode on the basis of display data for a display cell on the scan electrode. As a result, opposite discharge in the direction perpendicular to the substrates is generated between the scan electrode and the data electrode. Further, this opposite discharge serves a trigger, and planar discharge in the direction parallel to the substrate surface is generated between the sustaining electrode and the scan electrode. Write operation is thus completed. By this write discharge, wall charge is formed on the surface over the scan electrode and the sustaining electrode. In a cell having wall charge formed therein, sustaining discharge of planar discharge is generated by a sustaining pulse applied between the sustaining electrode and the scan electrode. In a cell for which writing has not been conducted, however, sustaining discharge is not generated even if a sustaining pulse is applied, because there is no superposition effect of the electric field brought by wall charge. By applying the sustaining pulses a predetermined times, light emission display is conducted. By the way, in order to enhance the write operation performance, pre-discharge operation, wherein a high voltage is applied to all cells prior to the write operation to erase the past record of the display state and forcibly cause discharge or the like is adopted. As heretofore described, the plasma display driving sequence is formed by a sequence of the preparation operation, write operation, and sustaining light emitting operation.

Although the write interval and the sustaining interval are separated in the above explanation, these intervals may be overlapped partially under the condition that the write operation is disposed after the preparation operation, and thereafter the sustaining operation is disposed.

The sub-field method is used for displaying gradation. Because voltage modulation of the light emitting display luminance is difficult in an AC type plasma display device, and it is necessary to change the number of times of light emission for luminance modulation. The sub-field method includes the steps of resolving one image having gradations into a plurality of binary display images, displaying the binary display images consecutively at high speed, and reproducing a multi-step gradation image by using a visual integration effect.

FIG. 12 shows an example, wherein an image of 256 step gradation is represented by 8 sub-fields. Image luminance signal data is digitized by using a binary code having ratios of 128: 64: 32: 16: 8: 4: 2: 1, and sub-fields having a number of sustaining pulses which provide luminance values corresponding to the respective step of gradation are assigned. The number of sustaining pulses of each sub-field is adjusted so that a top sub-field SF1 supplies a maximum luminance, SF2 supplies a luminance equivalent to half of the luminance of SF1, and SF8 supplies a luminance of the lowest order. Sub-fields are selected, in accordance with the gradation level of each discharge cell.

However, spurious image occurs in moving pictures in the PDP. Therefore, redundant codes are added for the prevention of the spurious image. Accordingly, for example, more than nine sub-fields are required for 256 steps gradation display. As a result, the sustaining interval directly contributing to the light emission must be shortened.

The light emission efficiency of plasma display is not so high. In the case of bright display over the whole panel serface, such as the whole white, therefore, electric power consumption is increased, resulting in a problem of power dissipation and a problem of heat generation of the panel and the circuit. Therefore, when the average luminance of the panel surface is low, it is necessary to fall down the whole white luminance and at the same time to raise the peak luminance, when the average luminance of the panel surface is low. Concretely, an average luminance level of the whole panel surface (APL) is detected, and the number of the sustaining discharge pulses of each sub-field is changed according thereto. When the APL is low, the number of sustaining discharge pulses is increased. On the other hand, when the APL is high, the number of sustaining discharge pulses is decreased.

FIG. 13 schematically shows the relation between the APL level and the number of sustaining pulses. In this example, Eight steps are used for the APL level. The lowest level is provided with APL level 0, whereas a state near the whole white state is provided with APL level 7. The ordinate represents the number of sustaining pulses per frame and indicates the number of sustaining pulses at each APL level. In the whole white state, the number of sustaining pulses is 510 even at the luminance level 255 which is the highest luminance level. At the APL level 0 providing a peak luminance, however, the number of sustaining pulses is 1020 at the luminance level 255. Namely, as many sustaining pulses as twice the number of sustaining pulses for the whole white display are applied. A peak luminance which is approximately twice the whole white luminance is implemented. For reference, the number of sustaining pulses at the gradation level 127 in each APL level is also shown in FIG. 13.

The power consumption becomes maximum at the time of the whole white display. Without causing an increase of the maximum power dissipation, it is possible to attempt to increase the peak luminance when the APL level is small. As for the APL detection, there are various methods. In the case of plasma display, however, luminance data is handled by a digital signal and the APL level can be detected easily by simple digital signal processing. Further, setting the number of sustaining pulses of each sub-field corresponding to each APL level can be conducted simply by using, for example, a look-up table (LUT) . In the example of FIG. 13, the number of steps of the APL control has been set to be 8 for simplicity. In order to make brightness changes at transitions between the steps smoother, however, further more gradation steps are being employed for the PDP in practical use.

The method of controlling the number of sustaining pulses with information corresponding to the APL level for reducing the maximum power dissipation and for increasing the peak luminance as described above is called power saving method or peak luminance enhancing (PLE) method.

Although above described PLE method is useful for the plasma display, but it is still insufficient as compared with CRT. Therefore, further improvement thereof is desired. For example, the write interval in the PDP in practical use must be long, particularly, for achieving higher gradations, improved quality of moving pictures, and large capacity display. In this case, the sustaining interval directly relating to the light emission luminance must be further shortened.

As a result, there is a disadvantage that the peak luminance can not be made sufficiently high by the conventional PDP. If the repetition period of the sustaining pulses is shortened, it is possible to apply many sustaining pulses during the sustaining interval, thereby raising the display luminance. In this case, however, the light emission efficiency is lowered due to the saturation phenomenon of the fluorescent substance and ultraviolet light emission. Therefore, the increased power consumption does not pay the increase in the panel luminance.

Further, the luminance ratio PL/WL of the peak luminance PL to the whole white luminance WL can not be made so high. The ratio PL/WL is typically 2 to 3, and it is low as compared with CRT. This is because the sustaining interval for defining the peak luminance can not be made sufficiently long. Further, the gradation can not be displayed smoothly, when the peak luminance of 400 cd/m$^2$ with 256 step gradation for PDP is required. Here, 400 cd/m$^2$ luminance is easily obtained on the CRT. This is because one gradation level corresponds to 1.5 cd/m$^2$ in. Therefore, dark scenes become unnatural on PDP. On the other hand, even when the peak luminance is high on the CRT, the smoothness of the gradation is not hampered, because of the analogue expression of gradation. Therefore, conventional PDP has another disadvantage that the gradation is not displayed smoothly, compared with the CRT. This is because the PDP displays the gradation by using digital signal.

SUMMARY OF THE INVENTION

Therefore, an object of the present invention is to improve the PLE method of controlling the number of times of sustaining discharge according to the average luminance of a display panel as a whole (APL); to achieve a higher peak luminance, reduced power dissipation, and smoother gradation display.

In the present invention, luminance levels are determined according to scenes. Further, a number of sustaining discharge pulses is determined for each of the luminance levels. Further, the period of the sustaining discharge (SD) pulses in case of the luminance level being lower than a predetermined value is made shorter than the period of SD pulses in case of the luminance level being greater than or equal to the predetermined value.

Further, in the present invention, a plurality of luminance levels are determined according to a scene, luminance distribution of the scene having the luminance level lower than the predetermined value is detected, maximum luminance of a portion having maximum luminance is derived from the luminance distribution, and the number of sustaining discharge pulses is made large as the maximum luminance becomes large.

Further, in the present invention, a plurality of luminance levels are determined according to a scene, a number of sustaining discharge pulses is determined for each of the luminance levels, a period of the sustaining discharge pulses in case where the luminance level is lower than a predetermined value is made shorter than a period of the sustaining discharge pulses in case where the luminance level is greater than the predetermined value, luminance distribution of the scene having the luminance level lower than the predetermined value is detected, maximum luminance of a portion having maximum luminance is derived from the luminance distribution, and the number of sustaining discharge pulses is made large as the maximum luminance becomes large.

In accordance with the present invention heretofore described, the peak luminance of an image having a bright minute portion in a dark scene is raised by controlling the sustaining pulse period and the number of each sub-field according to APL which is an average value of the scene brightness. As a result, clear image is displayed on the PDP. Further, for the display of the whole white state requiring large discharge light emission power, it is possible to improve the light emission efficiency and reduce the maximum power dissipation. Further, luminance distribution especially in a scene having low APL is detected, and the number of sustaining pulses and the sustaining pulse period are controlled. In a small but bright area in the dark scene, therefore, the peak luminance is increased. In a scene which has no bright portion and which is dark as a whole, gradation smoothness is maintained. As a result, an excellent image quality is implemented. The characteristics heretofore described are desirable especially for TV display and they contribute to application of plasma display to TV.

PREFERRED EMBODIMENT OF THE INVENTION

Figure 1:
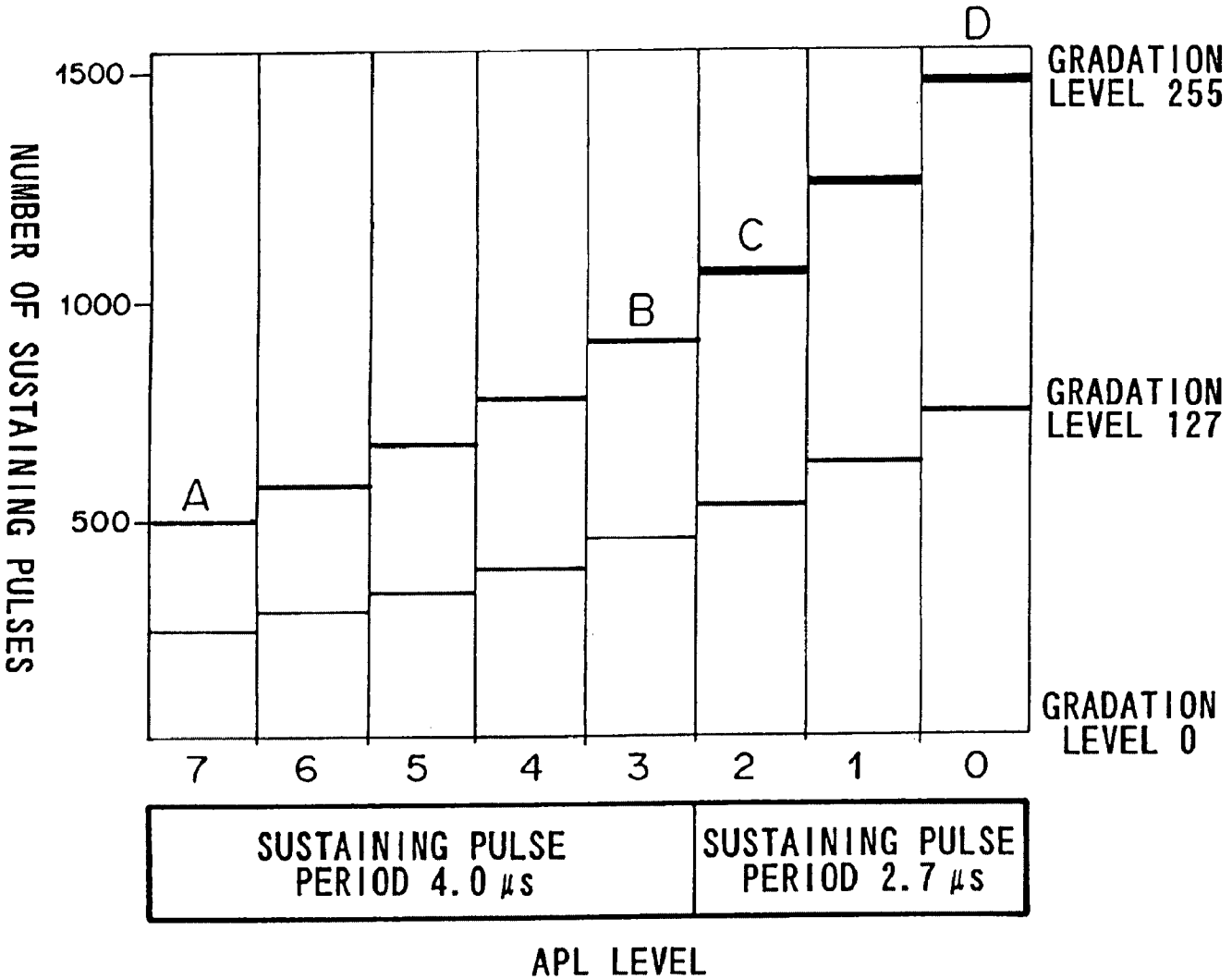
FIG. 1 is a graph for explaining the first embodiment of the present invention.

Hereafter, preferred embodiments of the present invention is explained, referring to the drawings.

(First Embodiment)

The first embodiment of the present invention is explained, referring to Examples.

(Example 1)

Figures 10A, 10B, 10C:
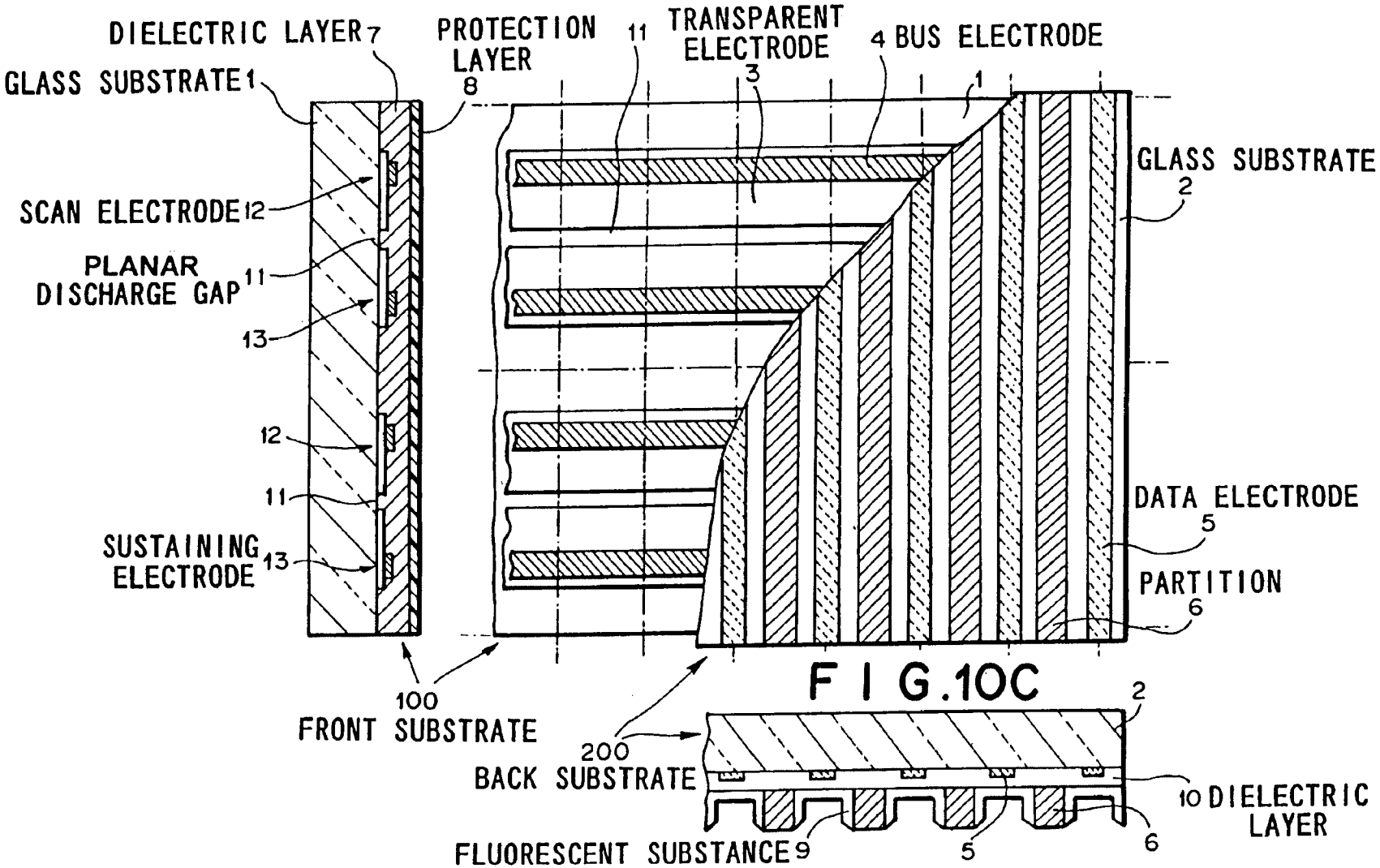
FIG. 10A is a top view of a back substrate of a color PDP.
FIG. 10B is a sectional view of the front substrate of the conventional color PDP as shown in FIG. 10A.
FIG. 10C is a sectional view of the back substrate of the conventional color PDP as shown in FIG. 10A.

In Example 1, a color PDP as shown in FIG. 10 is used in order to conduct full color display of 256 gradations. The configuration includes 9 sub-fields provided with redundancy codes. In one frame time of 16.7 ms, the write interval needs 12.5 ms and remaining approximately 4 ms is used as the sustaining interval. By adding image data signals of one frame and averaging them, an average luminance is detected. "Average" used here is an average over one to several pixels with one pixel being formed of a set of R, G and B. Further, eight steps of average peak luminance over the whole display surface of the PDP (APL levels) are determined according to the APL and the maximum luminance. In Example 1, 0 to 12.5% of the maximum luminance is defined as APL level 0, and 12.5% to 25% of the maximum luminance is defined as APL level 1, for brevity. APL level 7 is associated with 87.5% to 100% of the maximum luminance.

FIG. 1 shows the total value of sustaining pulses of one frame, i.e., each sub-field corresponding to each APL level, in its coordinate. In the APL level 7 which is close to the whole white display, the number of sustaining pulses is 510 at the gradation level 255 whereat all sub-fields conduct sustaining light emission. In the APL level 3, wherein APL is 37.5% to 50%, the number of sustaining pulses is set equal to 910. In the APL level 3 to the APL Level 7, the sustaining pulse period is set equal to 4.0 μs. In the present specification, the number of sustaining pulses is defined as the number of high voltage pulses with the polarity of applied pulses being neglected. Therefore, the number of sustaining pulses corresponds to the number of times of light emission in alternating current drive. Further, the period of sustaining pulses is indicated by the repetitive application period of high voltage pulses with the polarity being neglected in the same way. In the APL level 0 to the APL level 2, the sustaining pulse period is set to 2.7 μs. By shortening the sustaining pulse period, more sustaining pulses can be applied during the same sustaining interval. In the APL level 0, the number of sustaining pulses is set equal to 1530.

Figure 2:
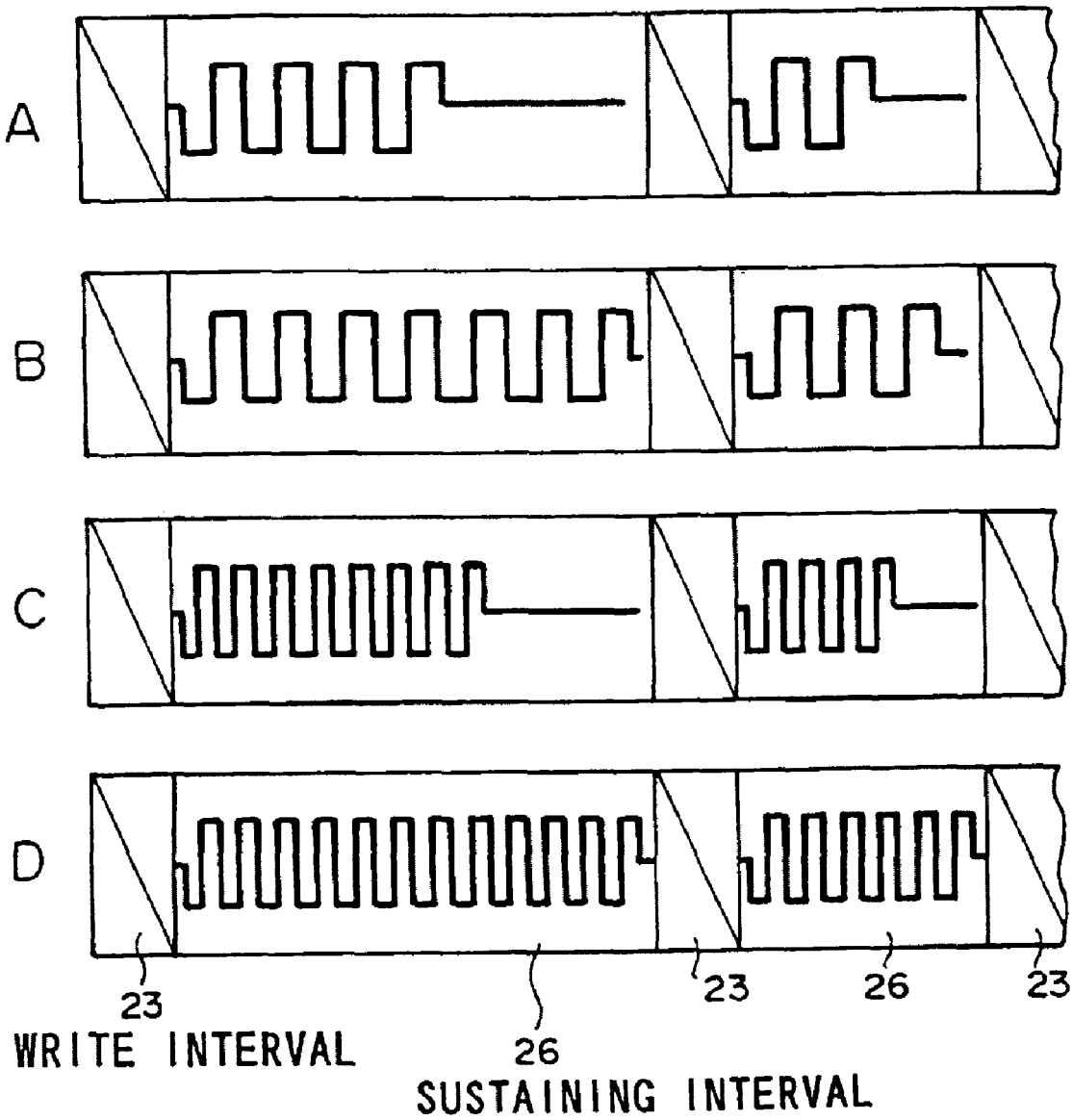
FIG. 2 is an illustration of driving waveforms in Example 1 of the first embodiment of the present invention.

FIG. 2 schematically shows a drive sequence depending on the APL level. In association with states A, B, C and D of FIG. 1, drive states shown in A, B, C and D of FIG. 2 are caused. In A and B, the period of sustaining pulses is long. In C and D, the period of sustaining pulses is short, and consequently many sustaining pulses are applied during the sustaining interval. In B and D, the sustaining pulses are applied during the nearly entire sustaining interval. When the sustaining pulse period is the same and the APL level is high, however, the sustaining interval becomes short and the blanking interval becomes long as shown in A and C of FIG. 2. By the way, the same effect is obtained, even if a blanking interval is not provided for each sub-field, but the next sub-field is put close forward and a long blanking interval is provided collectively at the end of the frame.

In an image having a low APL, the sustaining pulse period is short, and consequently a large number of sustaining pulses can be applied, and the number of sustaining pulses is three times that of the whole white state. The light emission luminance exhibits a saturation tendency with respect to shortening of the sustaining pulse period and the number of sustaining pulses. Therefore, the luminance does not become three times. Whereas the maximum luminance of the white color of the APL level 7 is 150 cd/m$^2$, 400 cd/m$^2$ which is approximately 2.7 times is implemented at the white color luminance of the APL level 0

Figure 11:
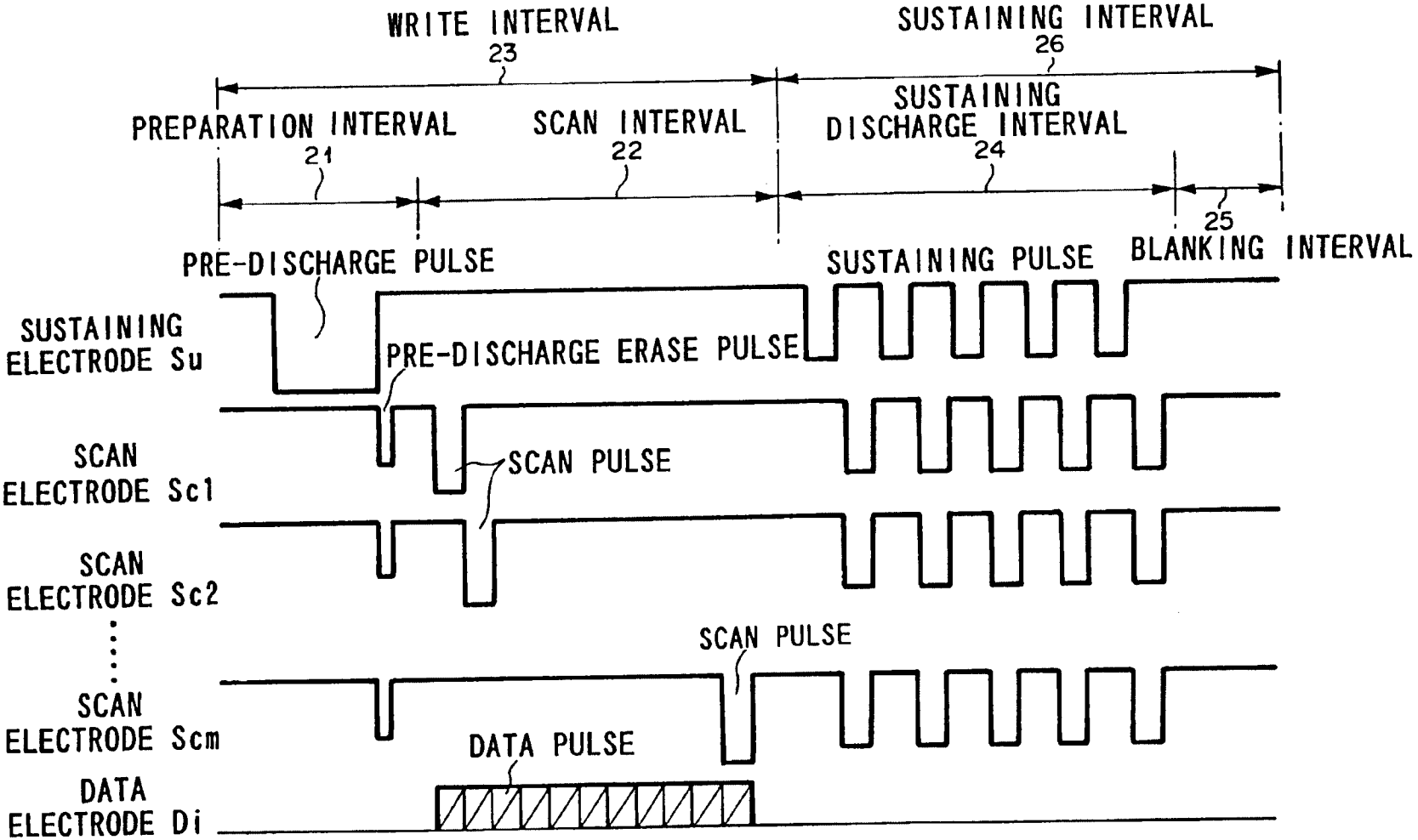
FIG. 11 is a timing chart of driving the PDP.

On the other hand, in the conventional example shown in FIG. 11, the sustaining pulse period remains 4.0 μs in the case of the APL level 0 as well. As for the number of pulses as well, pulses can be applied no more than 1020 times. Therefore, the white color luminance is 290 cd/m$^2$ .

In this way, a high peak luminance can be implemented in the present invention without prolonging the sustaining interval. Further, the maximum power dissipation is caused when APL is large such as the whole white display. In this state, the same sustaining pulse period and number of sustaining pulses as those of the prior art are set, and the maximum power dissipation does not increase.

(Example 2)

In Example 2, there are provided three kinds of sustaining pulse period. However, the set number of sustaining pulse periods depending on the APL level may be further increased to three or more. In this case, a highly peak luminance can be implemented.

Figure 3:
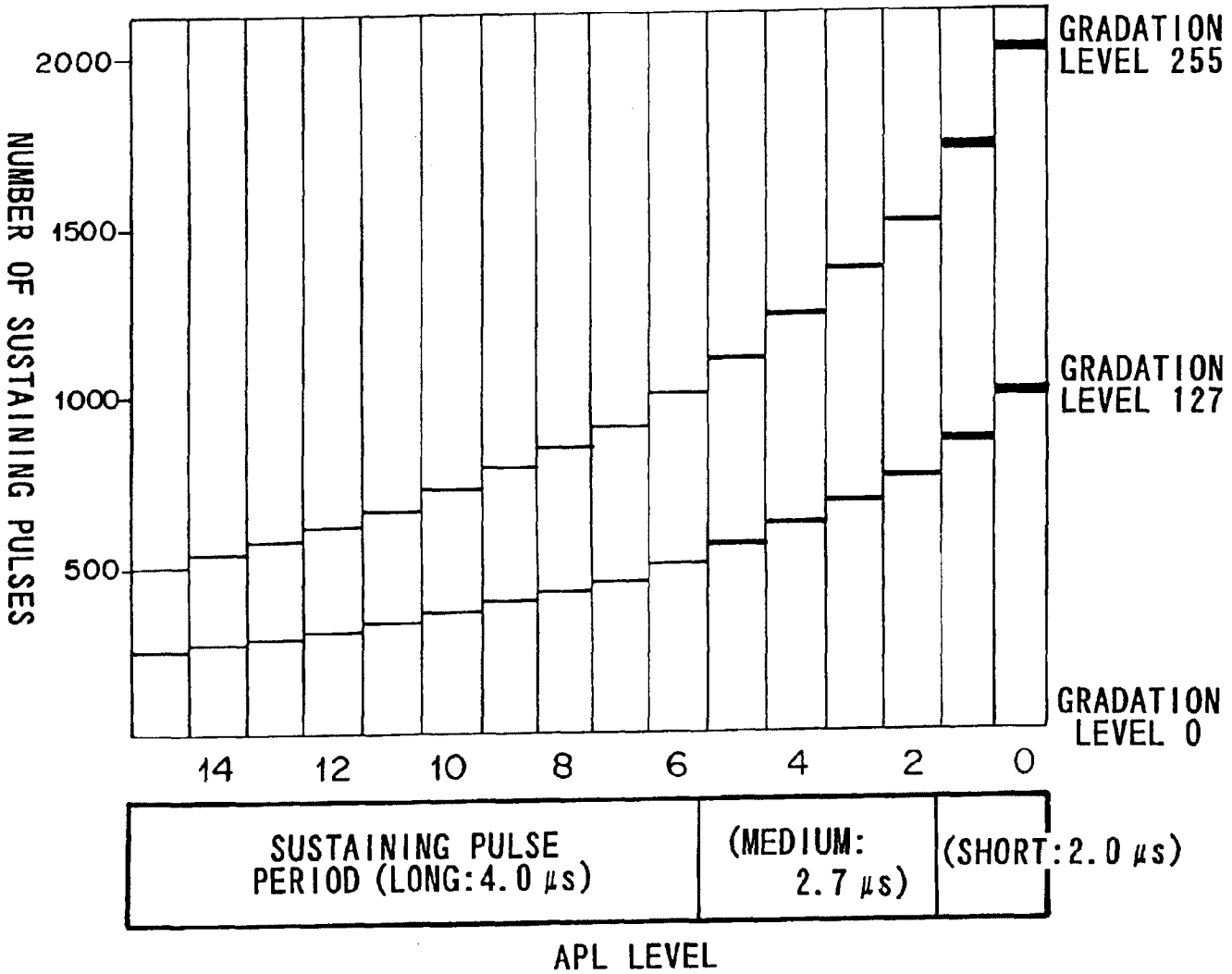
FIG. 3 is a graph for explaining Example 2 of the first embodiment of the present invention.
Figure 4:
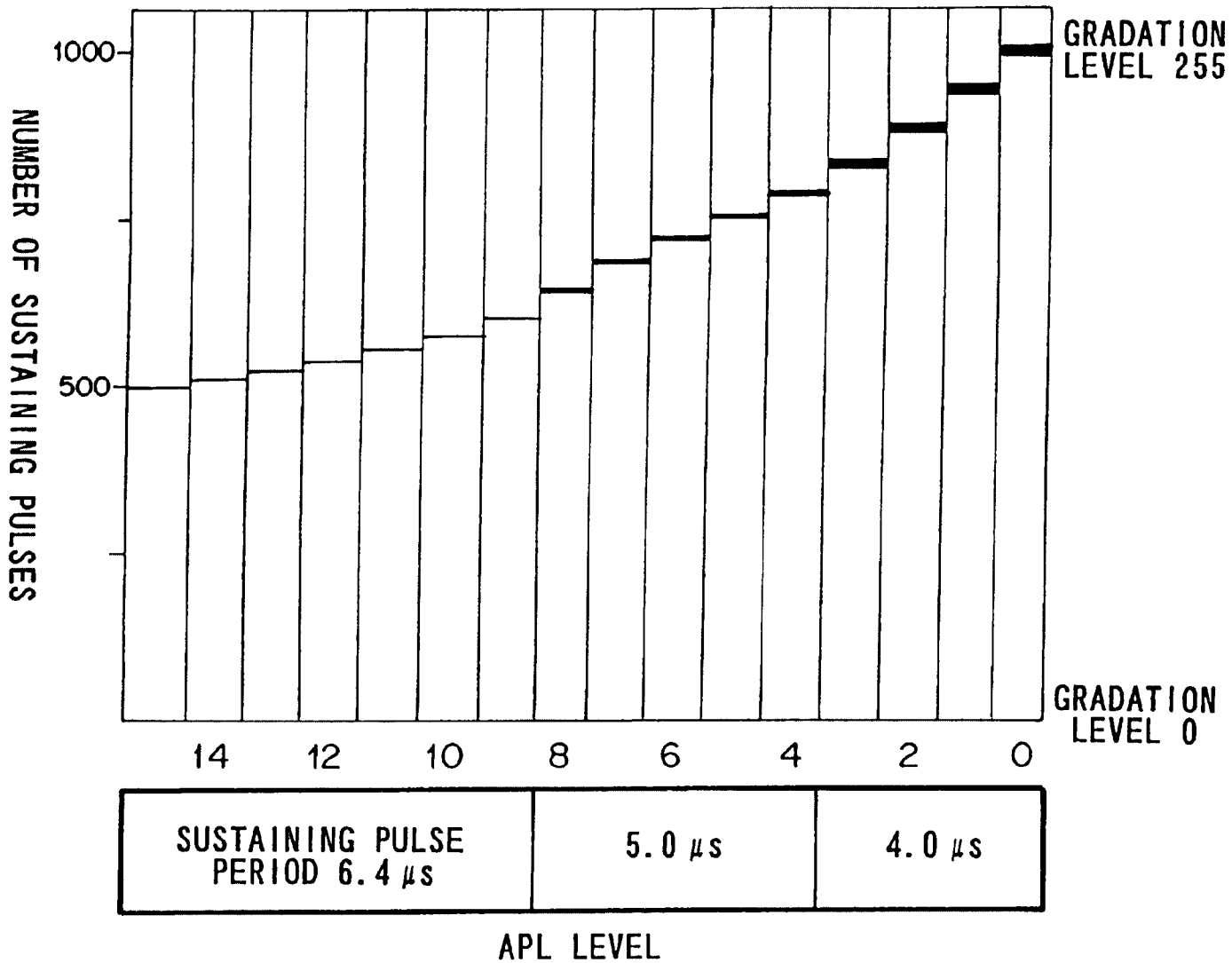
FIG. 4 is a graph for explaining Example 3 of the first embodiment of the present invention.

As shown in FIG. 3, the APL level is provided with 16 steps. In the APL levels 0 and 1, the sustaining pulse period is set to 2.0 μs. In the APL levels 2 to 5, the sustaining pulse period is set to 2.7 μs . In the APL levels 6 to 15, the sustaining pulse period is set to be 4.0 μs. When APL is high, Example 2 is similar to the first embodiment. In display of an image having a small APL, the sustaining pulse period is set to a further shorter value, and consequently a number of sustaining pulses equivalent to approximately 2000 which is four times that of APL 15 can be set. As a result, the peak luminance 490 cd/m$^2$ of the white color in the APL level 0 is obtained for the white color luminance 150 cd/m$^2$.

In the case of Example 2 as well, the maximum power dissipation of the plasma display device is caused in the case of the whole color display. Therefore, the peak luminance becomes very high. Further, the maximum power dissipation can be made the same as that of the prior art device. In typical TV display, there are many images which are approximately 30% in APL. In Example 2, the plasma display device operates with a sustaining pulse period of 2.7 μs in many cases. As compared with the prior art device setting of FIG. 12 and the embodiment of FIG. 1, display having a luminance which is approximately 1.3 to 1.7 times a standard image is implemented.

(Example 3)

Example 3 does not aim at an increase of the peak luminance, but aims at improvement of the light emission efficiency and resultant improvement of the whole white luminance and reduction of the power dissipation.

Figure 13:
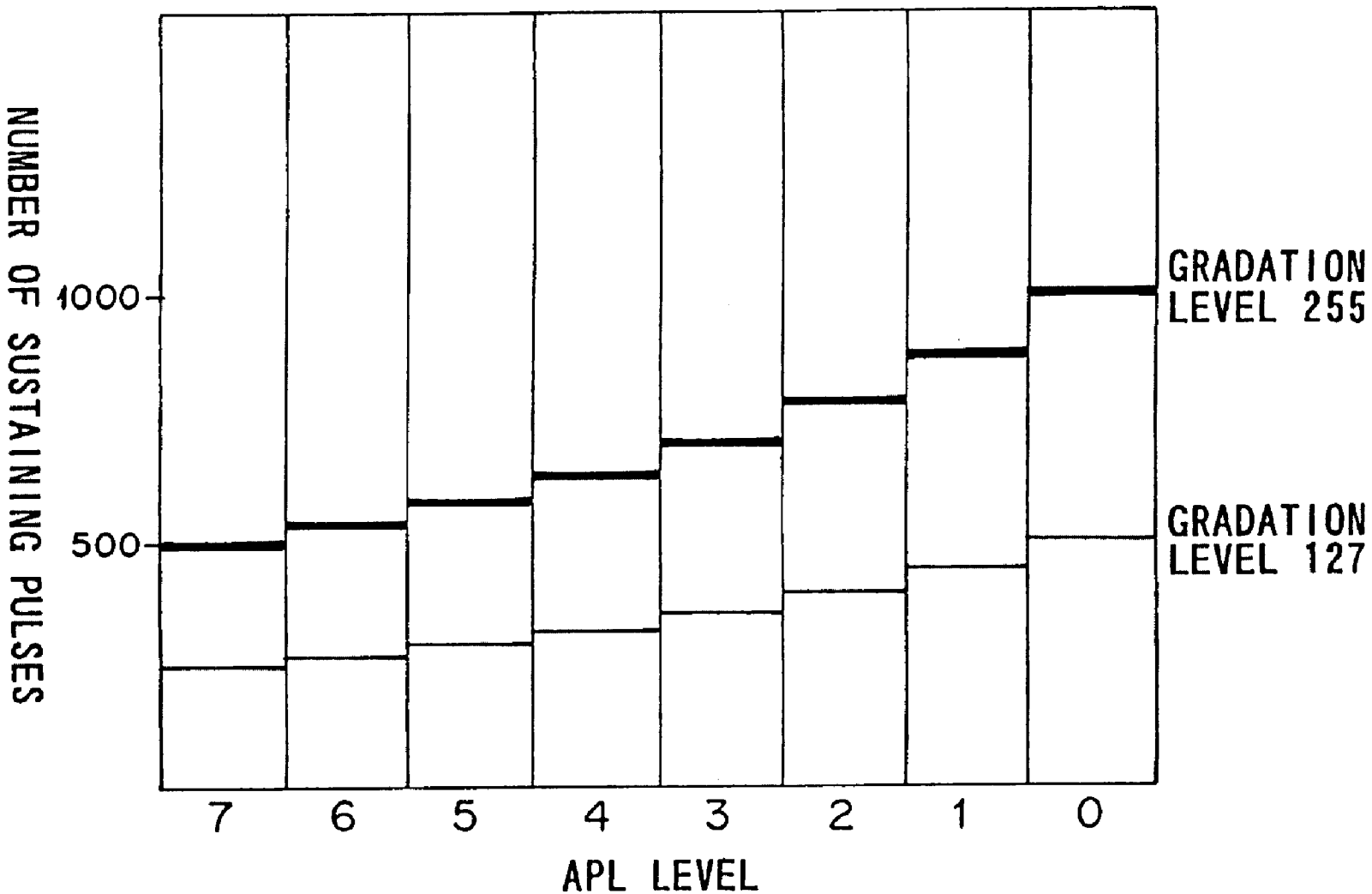
FIG. 13 is a graph explaining a conventional PLE method.

The sustaining interval is set equal to 4 ms in the same way as the above described example. In the sustaining interval, 256 gradation display and APL of 16 steps are set. When APL is small, the number of sustaining pulses is set equal to 1020 which is twice of that at the time of the whole white display. In the APL levels 0 to 3, the sustaining pulse period is set to 4.0 μs. In the APL levels 4 to 8, the sustaining pulse period is set to be 5.0 μs. In the APL levels 9 to 15 having a large display load, the sustaining pulse period is set to 6.4 μs. By such setting, a whole white luminance of 165 cd/$m^2$ and a peak luminance of 290 cd/$m^2$ are obtained. At the time of the whole white display in FIG. 13 illustrating the conventional example, the sustaining pulse period is 4.0 μs. On the other hand, in this present embodiment, wherein the sustaining period is changed according to APL, a long pulse spacing of 6.4 μs can be adopted. As a result, the saturation of the fluorescent substance light emission can be reduced, and the light emission efficiency can be increased by 10%.

The case where the APL level is small is similar to FIG. 13. Therefore, the peak luminance is equivalent to that of the conventional example. If the whole white luminance is set close to that of the prior art, the maximum power dissipation can be reduced by an amount of improvement of the light emission efficiency.

With respect to the conventional example, the case where the peak luminance is increased and the case where the whole white luminance is increased or the maximum power dissipation is reduced according to the present invention has heretofore been described. Intermediate setting can also be conducted.

Figure 14:
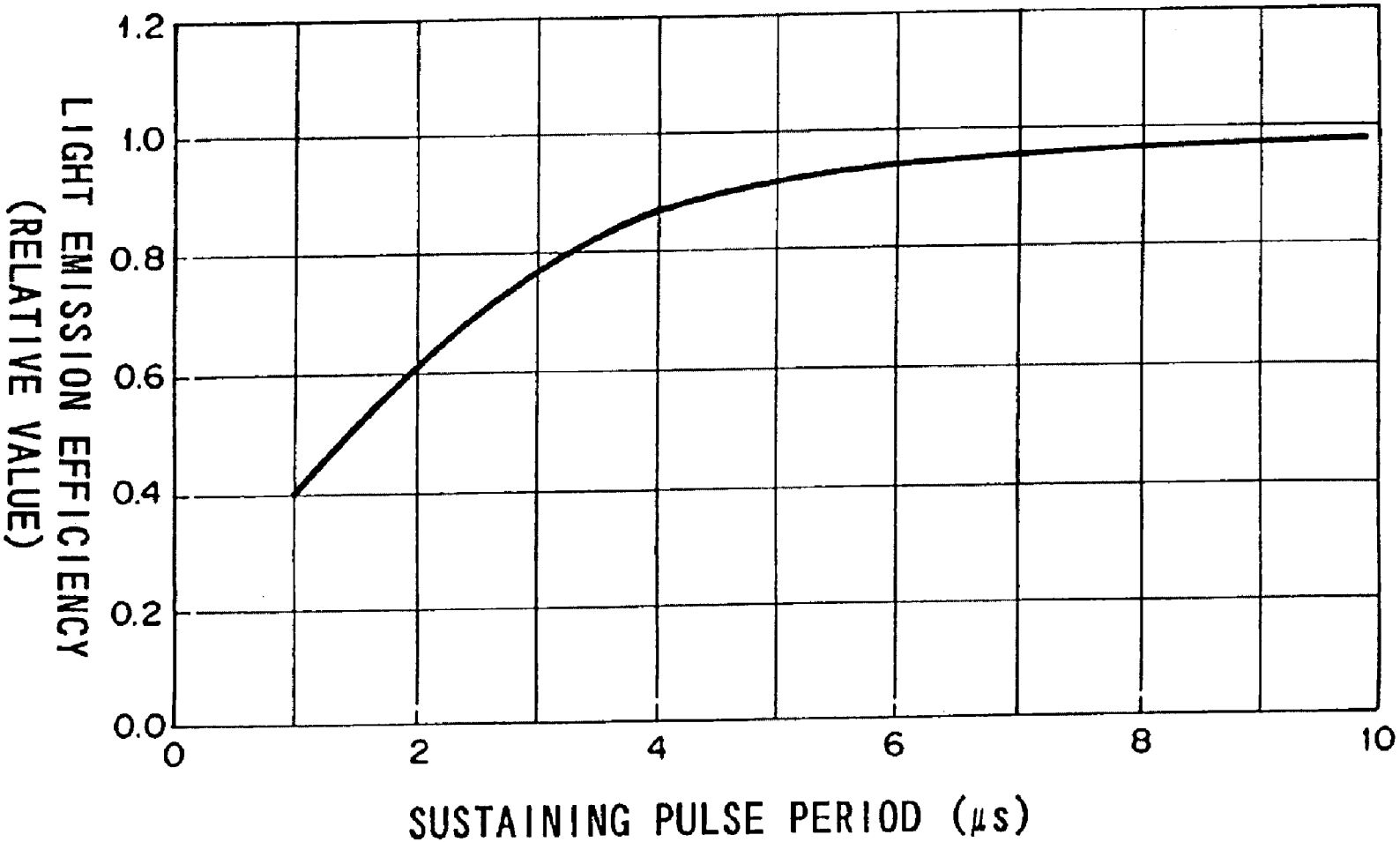
FIG. 14 is a graph for explaining a relation of sustaining pulse period and light emission efficiency.

FIG. 14 shows the relation between the sustaining pulse period and the white color light emission efficiency. Even if the sustaining pulse period is shortened and the number of sustaining pulses in unit time is increased, the luminance of the color plasma display exhibits the saturation tendency. This is caused by the saturation of the fluorescent substance and ultraviolet light generation resulting from gaseous discharge. Especially the saturation tendency in green and red is remarkable, because a fluorescent substance having a long persistence of at least 5 ms is used. In blue as well, the persistence of the fluorescent substance itself is short, but a saturation tendency is exhibited when the sustaining pulse period has become short under the influence of the saturation of the ultraviolet ray generation.

Figure 12:
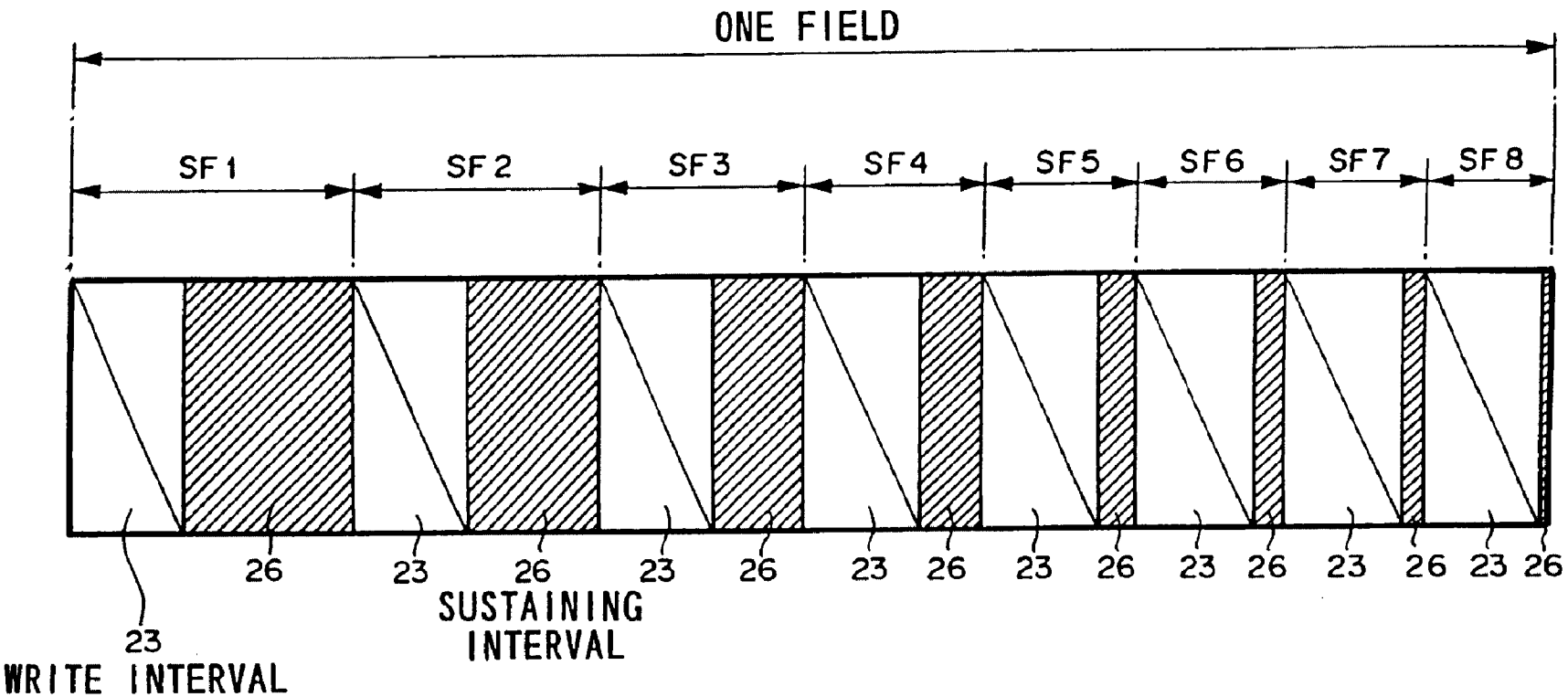
FIG. 12 is an illustration explaining the sub-field.

As shown in a sub-field sequence of FIG. 12, sustaining intervals are dispersed and pause intervals during which sustaining intervals are not applied are included in actual plasma display devices. As compared with the case where sustaining pulses are applied consecutively, therefore, the saturation of the light emission efficiency tends to be slightly reduced even at the same sustaining pulse period. However, the luminance saturates considerably at a sustaining pulse period of approximately 3 μs typically adopted. FIG. 14 shows measurement result under the condition that the number of sub-fields is 10, namely sustaining intervals are divided into ten places in each frame, and the total time is 4 ms, so as to guarantee the same sequence as the practical plasma display device. In place of the luminance, the luminance has been converted into a relative efficiency and the relative efficiency is shown. When the sustaining pulse period is 5 μs or more, the decrease of the light emission efficiency becomes remarkable. When the sustaining pulse period is 1.5 μs or more, the light emission efficiency is reduced to half.

When APL is high, for example, when the whole white display causing maximum power, therefore, it is desirable to make the sustaining pulse period long to the utmost. If the sustaining pulse period is made too long, the number of sustaining pulses can not be ensured and the luminance is lowered. Therefore, it is necessary to choose a suitable setting value. It is desirable to set the sustaining pulse period equal to at least 4 μs, wherein the efficiency lowering caused by saturation is still slight. Further, the sustaining pulse period when APL is small is determined by specifications of the peak luminance. As shown in FIG. 14, however, the efficiency lowers greatly, when the sustaining pulse period is 1.5 μs or shorter. Therefore, it is desirable to set the sustaining pulse period to a range of 1.5 μs to 4 μs. Further, for the reduction of the maximum power and the improvement of the peak luminance which is the effect of the present invention, it is desirable to set the period ratio SPH/SPL of the sustaining pulse period SPH in the case of the APL being high to the sustaining pulse period SPL in the case of the APL being low is made greater than 1.3. However, if this ratio is made too high, the light emission efficiency lowers remarkably, when APL is low. Therefore, it is desirable to set the ratio equal to 5 at most.

Figure 5:
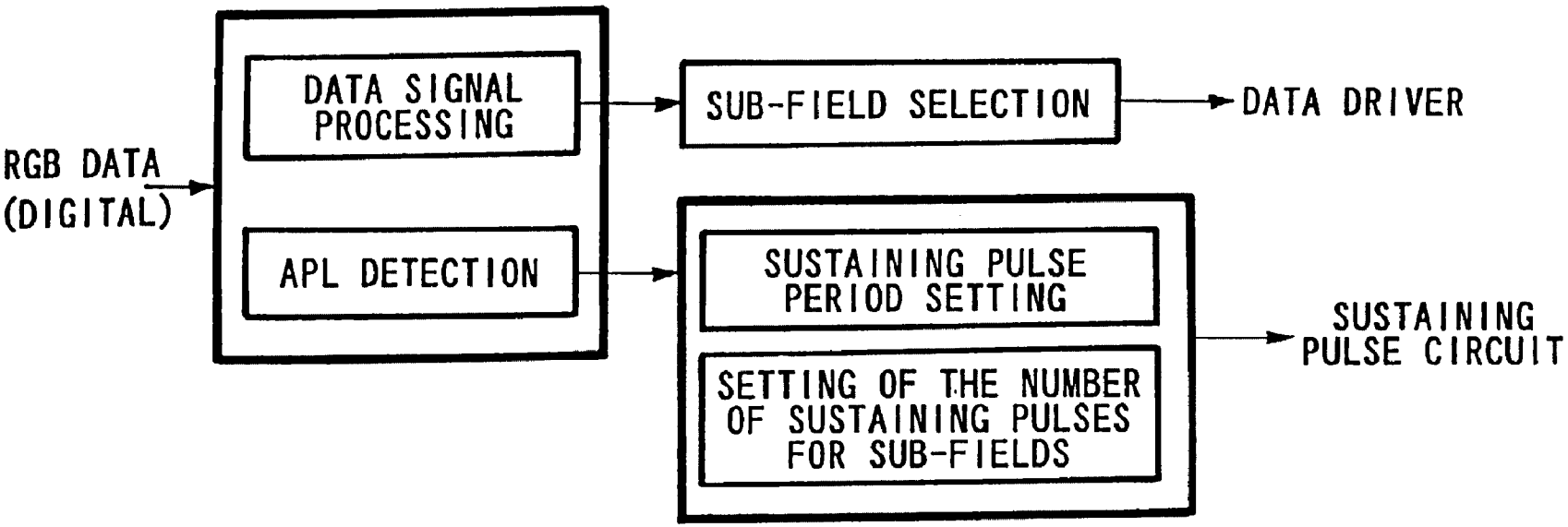
FIG. 5 is a block diagram of the apparatus for enhancing peak luminance on PDP under the first embodiment of the present invention.
Figure 6:
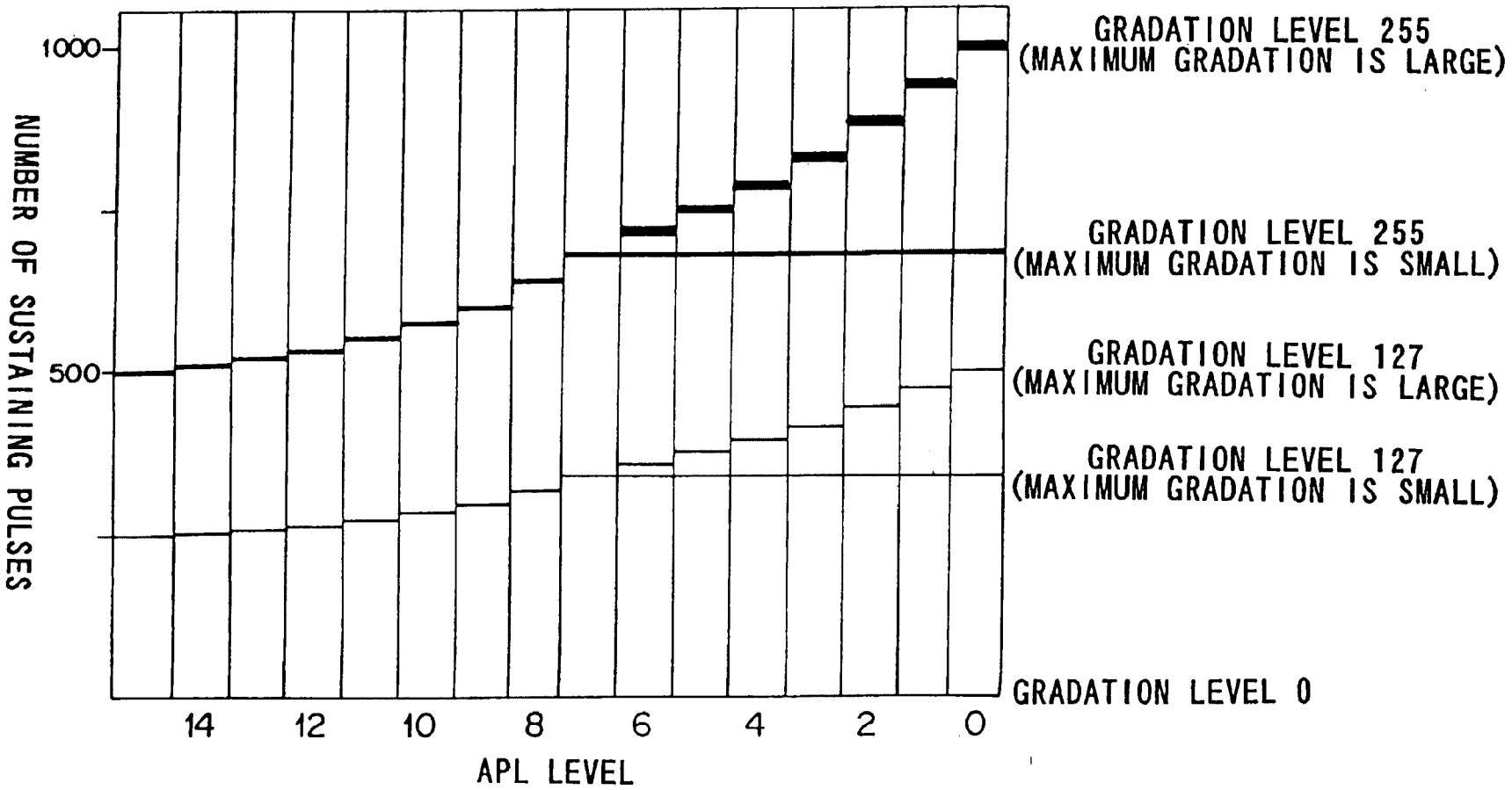
FIG. 6 is a graph for explaining Example 4 of the second embodiment of the present invention.

FIG. 5 is a block diagram of the PLE apparatus of the first embodiment of the present invention. On the basis of an RGB digital signal output through the data signal processing means such as a video signal processing circuit, an AD conversion circuit, a γ conversion circuit selects the sub-field. APL detection means detects the APL. Sustaining pulse period setting means sets up the sustaining pulse period, while the sustaining pulse number setting means sets up the number of sustaining pulses for the sub-fields by using a look up table (LUT) and a computation circuit.

In the prior art, only the number of sustaining pulses of each sub-field is set up. On the other hand, the LUT is employed for determining the sustaining pulse periods in accordance with the APL levels, in the present invention. For reducing a luminance skip when the APL level changes, it is desirable to increase the number of APL steps, up to, for example, 32 steps. In this case, the sustaining pulse period also be set according to all APL steps in the same way as the setting of the number of sustaining pulses. As for the setting of the sustaining pulse period according to the APL level, approximately up to five kinds are effectively sufficient, and instead the APL steps can be increased in the setting of the number of sustaining pulses. Increasing the APL steps in the setting of the number of sustaining pulses is also desirable in order to avoid the disadvantage caused by delicate timing of a high voltage sustaining pulse generation circuit including a charge recovery circuit. Because of a problem such as luminance saturation according to the sustaining pulse period and timing setting, a trouble such as a reversal of luminance between adjacent APL levels of different sustaining pulse periods occurs in some cases. As for the number of sustaining pulses, it is desirable to measure the luminance in a practical device and finally adjust the numbers of sustaining pulses.

(Second Embodiment)

In the second embodiment, in addition to the control of the number of sustaining pulses conducted by APL, the number of sustaining pulses is also controlled by taking brightness distribution information in the scene into consideration. The second embodiment is explained, referring to Examples.

(Example 4)

In Example 4, setting of the APL levels and setting of the number of sustaining pulses are conducted in the same way as Example 3. The sustaining interval in each frame is set to approximately 4 ms. In all AP levels, the sustaining pulse period is set to 4.0 μs. When the APL level is 6 or lower, the number of sustaining pulses is set to be a number of sustaining pulses indicated by thick lines. For example, in a scene of the APL level 0, 1020 sustaining pulses are applied to a pixel of a gradation level 255, and a high peak luminance is obtained. On the contrary, when the APL level is low and the maximum luminance of the scene is also low, the number of sustaining pulses is held down to 680 even in the case of APL level 0. In other words, even in the scenes having the same average luminance, different numbers of sustaining pulses are selected according to the maximum luminance in the scene. In a scene which is dark as a whole and which has a small bright area, the small and bright area is displayed with higher brightness. In this case, the absolute value of luminance per gradation also becomes high, and the smoothness of the gradation display is hampered. However, the emphasis of the high luminance portion has a greater effect on the audiences. On the contrary, in a scene which is dark as a whole and which has not any bright but small part, the number of sustaining pulses is decreased in order to reduce luminance skips between gradation steps so as to prevent the gradation smoothness in the dark scene from being hampered.

Example 4 is effectively combined with the first embodiment, wherein a higher peak luminance is implemented by shortening the sustaining pulse period to increase the number of sustaining pulses in a low APL area.

(Example 5)

Figure 7:
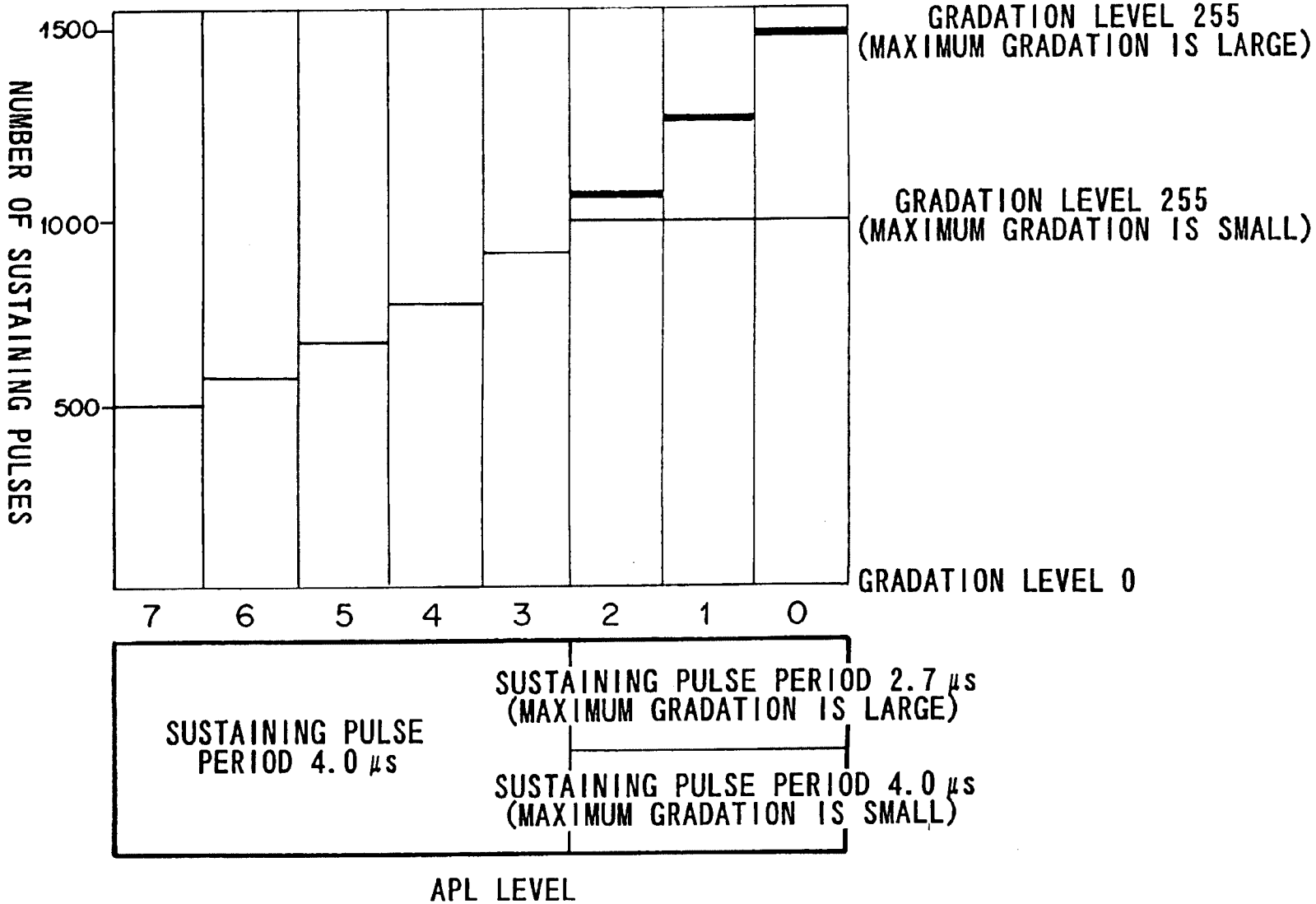
FIG. 7 is a graph for explaining Example 5 of the second embodiment of the present invention.

FIG. 7 shows Example 5 applied to a plasma display, wherein 256 gradation display is conducted, the APL level has 8 steps, and the sustaining time of each frame is 4 ms. In the APL level of at least 3, the sustaining pulse period is 4.0 μs. The number of sustaining pulses is set up for each APL level. In the APL level of 2 or lower, the sustaining pulse period is as short as 2.7 μs when the maximum gradation is high, in the same way as the first embodiment of the present invention. The number of sustaining pulse also increases as the APL level is lowered. In the APL level 0, the number of sustaining pulses becomes 1530, and a high peak luminance of 400 cd/m$^2$ is obtained. In this case, digitized 256-gradation is display. Each gradation is as small as 1.6 cd/m$^2$ and the smoothness of gradations is hampered. However, the high luminance parts of the scene give more favorable impression to the audiences, when displayed by a higher peak luminance. On the other hand, when the APL level is 2 or lower and the maximum gradation level in the scene is also low, the sustaining pulse period is set up to be 4.0 μs and the number of sustaining pulse is also set to 1020, in steps of APL levels 0 to 2 as well. Therefore, a luminance change of one gradation is 1.1 cd/m$^2$, and the gradation smoothness is not hampered greatly.

(Example 6)

Figure 8:
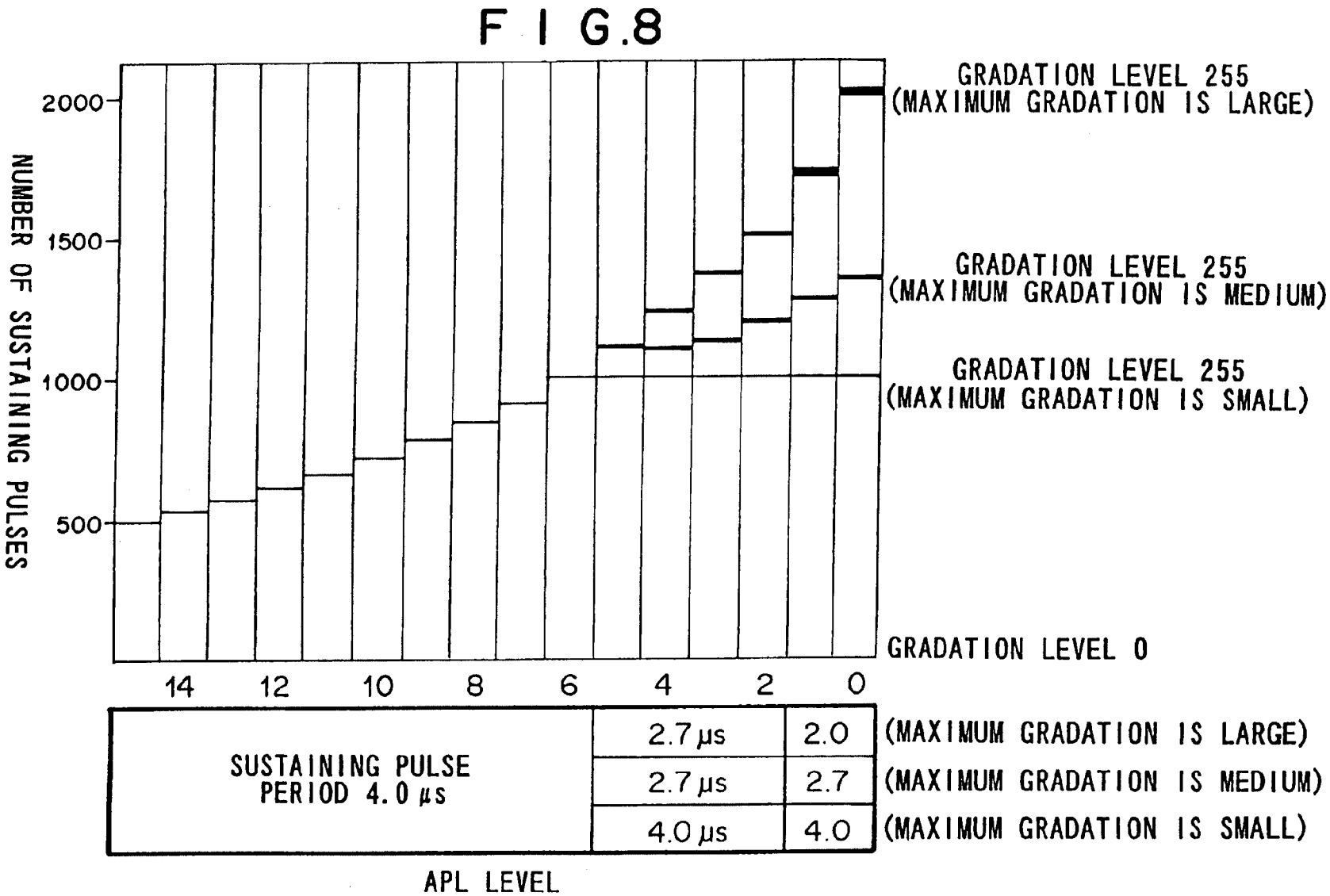
FIG. 8 is a graph for explaining Example 6 of the second embodiment of the present invention.

FIG. 8 shows an example, wherein an image quality control according to APL and luminance distribution information in the scene is provided by increased steps of garadation. In APL levels 6 to 15 among APL levels of 16 steps, the sustaining pulse period is set equal to 4.0 μs. The number of sustaining pulses in the APL level 6 is set to twice the number of sustaining pulses in the APL level 15. In the APL level of 5 or lower, a set of the sustaining pulse period and the number of sustaining pulses is selected according to the APL level and the maximum gradation of the scene. In the case of APL levels 2 to 5 as shown in FIG. 8, the sustaining pulse period is set equal to 2.7 μs when the maximum gradation in the scene is medium or high. The sustaining pulse period is set equal to 4.0 μs when the maximum gradation is low. In this case, the number of sustaining pulses is set so as to become greater, when the maximum gradation becomes higher. Further, in the APL levels 0 and 1, the sustaining pulse period is set equal to 2.0 μs and the number of sustaining pulses is also set to a large value, when the maximum gradation is high. In the APL level 0, the number of sustaining pulses is approximately 2040, and a peak luminance of 490 cd/m$^2$ is obtained. When the maximum gradation of the scene is medium, the sustaining pulse period is 2.7 μs and the number of sustaining pulses is also set to 1360 in the APL level 0. When the maximum gradation is far small, namely APL1 to APL0, the sustaining pulse period remains 4.0 μs and the number of sustaining pulses is also fixed to 1020. In an image which does not include a bright portion and which is dark as a whole, therefore, the gap of luminance per gradation is held down to approximately 1.1 cd/m$^2$, and the gradation smoothness is maintained. Further, in the present embodiment, the setting of sustaining pulses according to the maximum gradation of the scene is conducted in three stages, and the gap of brightness at the time when the maximum gradation of the scene changes becomes lower, resulting in more natural video display.

The electric power is consumed partly by the charge and discharge of the sustaining discharge. Although the electric power is recovered by a charge recovery circuit utilizing resonance, the loss of power caused by the charge and discharge is considerably high, because the high voltage pulses as many as 2040 times in 2.0 μs is applied, when the APL level is low, as explained in the second example. On the other hand, in Example 6 shown in the second embodiment of the invention, the number of pulses is 1020, when the maximum gradation of the scene is low, even if the APL level is minimum. The power loss caused by the charge and discharge also becomes half of example 2. In the device of the second embodiment of the present invention, an effective power dissipation is reduced.

Figure 9:
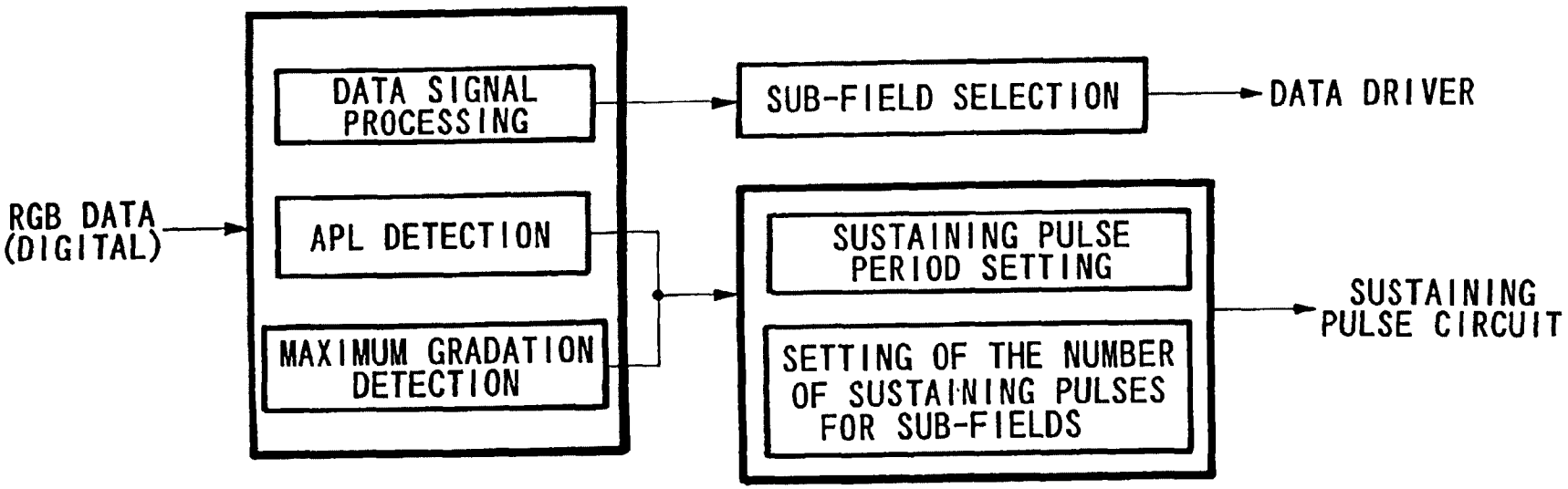
FIG. 9 is a block diagram of the apparatus for enhancing peak luminance on PDP under the second embodiment of the present invention.

A plasma display device of the present invention, wherein the sustaining pulse period and the number of sustaining pulses are adjusted according to the APL level and the luminance distribution state in the scene as heretofore described can be implemented easily by using a configuration of FIG. 9. As shown in FIG. 9, a function of detecting the luminance distribution of an image is added to the first embodiment as shown in FIG. 5. The APL level is determined according to the detected APL data by adding RGB digital data in the same way as is determined in the apparatus as shown in FIG. 5. The luminance distribution of the image is easily obtained by comparing the maximum luminance levels of the scene. In the case of Example 6, simple arithmetic mean of 8-bit RGB luminance data of respective pixels is calculated. Then, when the maximum value of the obtained average is 0 to 127, the maximum gradation is determined to be "small". When the maximum value is in the range of 128 to 159, the maximum gradation is determined to be "medium". When the maximum value is greater than 159, the maximum gradation is determind to be "high". In the present embodiment of the invention, the same determination criterion is employed in the APL levels 0 to 5. However, the criterion may be changed every APL level.

As for the criterion, it is desirable to provide RGB digital luminance data with appropriate weights and then conduct the determination of the maximum graduation level. Further, it is more desirable to put not only the maximum value detection but also, for example, the quantity of pixels each having a gradation level of at least a comparison value into the determination. For example, there may be adopted such a method that the maximum gradation is determined to be "high", when at least 300 pixels have gradation levels of at least 160. Further, in this case, the maximum gradation may be determined to be "medium", when the pixels having a gradation level of at least 160 are 160 to 300. This method is effective especially in an image having many white dot noises. Further, Although the maximum gradation is detected after the γ conversion and digitization of the video signal in FIG. 9, the maximum gradation may be detected by a preceding tuner section or video circuit section.

Heretofore, two embodiments of the present invention has been described. However, the number of steps of APL level, the way of division, setting of the number of sustaining pulses in each APL level, setting of the sustaining pulse period in each APL level, the number of divisions of the maximum gradation level, the decision scheme, the level settin are not limited to the above described two embodiments. By taking into consideration the specifications of the plasma display device to be manufactured and balance of image qualities, an optimum design can be conducted on the basis of the concept of the present scheme. Further, in the video signal, APL and the maximum gradation change with time. In the embodiment of the invention, therefore, control of both the number of sustaining pulses and the sustaining pulse period is conducted in real time. However, control may be conducted with a delay or control may be provided with hysteresis.

(Third Embodiment)

The third embodiment is explained, referring to Examples.

(Example 7)

As shown in the first and second embodiments of the invention, it becomes possible to make the number of sustaining pulses greater than that of the conventional PDP, when APL is low. Even in the whole black scene having no display at all, therefore, a large number of sustaining pulses are applied, and the power loss caused by the charge and discharge caused by the application of the sustaining pulse voltage also becomes high. Therefore, a function is introduced in the Example 2, for stopping the sustaining pulses, when the APL is 0 on the entire display area due to complete lack of image data. Therefore, the power loss caused by the wasteful charge and discharge is eliminated. The scan pulses, the pre-discharge pulses may also be stopped in the case of the whole black display.

(Example 8)

In Example 8, the sustaining pulse stopping function is expanded to the sub-fields. Concretely, a function is added to Example 6, for determining whether or not display data is present in each sub-field, when R, G and B digital data are converted to display data of each sub-field. In a sub-field without display data, the sustaining pulses are stopped. Especially when APL is low, the case where display is not present in a sub-field taking charge of a high gradation appears frequently, and consequently it is useful for reduction of power dissipation. It can also be determine easily whether display data is present for each sub-field, when display data of the sub-field is transferred to a data driver. As for the decision of the display data of the sub-field, it is not necessary to determine whether the display data is completely zero. Instead, it is possible to set such an appropriate level as not to substantially affect the display and stop the sustaining pulses at the level or lower. Further, the scan pulses and pre-discharge pulses may also be stopped, besides the sustaining pulses.

What is claimed is:

1. A peak luminance enhance (PLE) method for plasma display panel, which comprises the steps of:

determining a plurality of luminance levels (LLs), according to pixel data of a scene to be displayed;

determining a number of sustaining discharge (SD) pulses for each of said LLs;

determining a period of said SD pulses in case where said LL is lower than a predetermined value to be shorter than that of said SD pulses in case where said LL is greater than the predetermined value.

2. The PLE method according to claim 1, wherein two or more values are determined as said predetermined value.

3. A peak luminance enhance (PLE) method for plasma display panel, which comprises the steps of:

determining a plurality of luminance levels (LLs), according to pixel data of a scene to be displayed;

detecting a luminance distribution which has the luminance level lower than the predetermined value;

deriving a maximum luminance of a portion having maximum luminance on the basis of said luminance distribution; and making the number of sustaining discharge (SD) pulses greater, as said maximum luminance becomes higher.

4. The PLE method according to claim 3, wherein a period of said SD pulses is made shorter, as said maximum luminance becomes higher.

5. A peak luminance enhance (PLE) method for plasma display panel, which comprises the steps of:

determining a plurality of luminance levels (LLs), according to pixel data of a scene to be displayed;

determining a number of sustaining discharge (SD) pulses for each of said LLs; and determining a period of said SD pulses in case where said LL is lower than a predetermined value to be shorter than a period of said SD pulses in case where said LL is higher than said predetermined value, detecting a luminance distribution which has said LL lower than said predetermined value;

deriving a maximum luminance of a portion having said maximum luminance on the basis of said luminance distribution; and determining the number of SD pulses to be greater, as said maximum luminance becomes higher.

6. The PLE method according to claim 5, wherein a period of said SD pulses is made shorter, as said maximum luminance becomes higher.

7. The PLE method according to claim 1, wherein said period of said SD pulses in case where said LL is greater than said predetermined value is at least 4 microseconds.

8. The PLE method according to claim 4, wherein a period of said SD pulses in case where said LL is greater than said predetermined value is at least 4 microseconds.

9. The PLE method according to claim 6, wherein a period of said SD pulses in case where said LL is greater than said predetermined value is at least 4 microseconds.

10. The PLE method according to claim 1, wherein a ratio of the maximum period of said SD pulse to the minimum of said SD pulse is greater than or equal to 1.3 and smaller than or equal to 5.0.

11. The PLE method according to claim 4, wherein a ratio of the maximum period of said SD pulse to the minimum of said SD pulse is greater than or equal to 1.3 and smaller than or equal to 5.0.

12. The PLE method according to claim 6, wherein a ratio of the maximum period of said SD pulse to the minimum of said SD pulse is greater than or equal to 1.3 and smaller than or equal to 5.0.

13. The PLE method according to claim 7, wherein a ratio of the maximum period of said SD pulse to the minimum of said SD pulse is greater than or equal to 1.3 and smaller than or equal to 5.0.

14. The PLE method according to claim 8, wherein a ratio of the maximum period of said SD pulse to the minimum of said SD pulse is greater than or equal to 1.3 and smaller than or equal to 5.0.

15. The PLE method according to claim 9, wherein a ratio of the maximum period of said SD pulse to the minimum of said SD pulse is greater than or equal to 1.3 and smaller than or equal to 5.0.

16. The PLE method according to claim 1, wherein said SD pulses are stopped in case where said LL is equal to or lower than said prescribed value.

17. The PLE method according to claim 3, wherein said SD pulses are stopped in case where said LL is equal to or lower than said prescribed value.

18. The PLE method according to claim 5, wherein said SD pulses are stopped in case where said LL is equal to or lower than said prescribed value.

19. The PLE method according to claim 1, wherein said SD pulses for a sub-field are stopped in case where said LL of display data in said sub-field is equal to or lower than said prescribed value.

20. The PLE method according to claim 3, wherein said SD pulses for a sub-field are stopped in case where said LL of display data in said sub-field is equal to or lower than said prescribed value.

21. The PLE method according to claim 5, wherein said SD pulses for a sub-field are stopped in case where said LL of display data in said sub-field is equal to or lower than said prescribed value.

22. The PLE method according to claim 16, wherein pre-discharge pulses are stopped.

23. The PLE method according to claim 17, wherein pre-discharge pulses are stopped.

24. The PLE method according to claim 18, wherein pre-discharge pulses are stopped.

25. The PLE method according to claim 19, wherein pre-discharge pulses are stopped.

26. The PLE method according to claim 20, wherein pre-discharge pulses are stopped.

27. The PLE method according to claim 21, wherein pre-discharge pulses are stopped.

28. A peak luminance enhancement (PLE) apparatus for a plasma display panel, wherein an average picture level (APL)of a displayed picture is detected, and a period of sustaining discharge (SD) pulse is determined on the basis of said APL, which comprises:

a data processing means for processing digital RGB signal;

a sub-field selection means for selecting sub-fields on the basis of the output from said data processing means;

an APL detection means for detecting said APL on the basis of said digital RGB signal and for determining a plurality of luminance levels (LLs) for each of said sub-fields;

an SD pulse period setting means for setting up periods of said SD pulse for each of said sub-fields on the basis of the output from said APL detection means; and an SD pulse number setting means for setting up numbers for each of said sub-fields on the basis of the output from said APL detection means, wherein:

said numbers of SD pulses are determined for each of said LLs, and said period of said SD pulses in case where said LLs is lower than a predetermined value is shorter than a period of said SD pulses in case where said LL is greater than the predetermined value; and two or more values are determined as said predetermined value.

29. The PLE apparatus according to claim 28, which further includes a maximum luminance detection means for detecting a maximum luminance on the basis of a luminance distribution for portions of which LLs are lower than said predetermined value, wherein:

said number of sustaining discharge pulses is made large as the maximum luminance becomes higher;

said period of said SD pulses is made shorter, as said maximum luminance becomes higher.

30. The PLE apparatus according to claim 28, wherein a period of said SD pulses in case where the luminance level is higher than the predetermined value is made at least 4 microseconds.

31. The PLE apparatus according to claim 28, wherein a ratio MAX/MIN of a maximum value MAX of the period of the sustaining discharge pulses to a minimum value MIN thereof is in the range of 1.3 to 5.0.

32. The PLE apparatus according to claim 28, wherein the SD pulses are stopped in case where said LL is equal to or lower than said prescribed value.

33. The PLE apparatus according to claim 28, wherein the SD pulses for a sub-field are stopped in case where said LL of display data in the sub-field is equal to or lower than a prescribed value.

34. The PLE apparatus according to claim 28, wherein pre-discharge pulses are stopped.

* * * * *